US007044209B2

(12) United States Patent
Petersen

(10) Patent No.: US 7,044,209 B2
(45) Date of Patent: May 16, 2006

(54) HIGH PRESSURE MANIFOLD

(75) Inventor: Leif Petersen, Bramming (DK)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 10/486,153

(22) PCT Filed: Aug. 6, 2001

(86) PCT No.: PCT/EP01/09142

§ 371 (c)(1),
(2), (4) Date: Jun. 21, 2004

(87) PCT Pub. No.: WO03/014650

PCT Pub. Date: Feb. 20, 2003

(65) Prior Publication Data

US 2004/0251014 A1 Dec. 16, 2004

(51) Int. Cl.
*F29F 9/02* (2006.01)

(52) U.S. Cl. ..... 165/173; 165/174
(58) Field of Classification Search ..... 165/140, 165/172–175
See application file for complete search history.

(56) References Cited

U.S. PATENT DOCUMENTS

| | | | | |
|---|---|---|---|---|
| 4,448,242 | A * | 5/1984 | Andres et al. | 165/140 |
| 5,152,339 | A * | 10/1992 | Calleson | 165/173 |
| 5,163,507 | A * | 11/1992 | Joshi | 165/140 |
| 5,236,042 | A * | 8/1993 | Kado | 165/173 |
| 5,941,303 | A * | 8/1999 | Gowan et al. | 165/140 |
| 6,155,340 | A * | 12/2000 | Folkedal et al. | 165/175 |
| 6,216,776 | B1 * | 4/2001 | Kobayashi et al. | 165/173 |
| 6,675,882 | B1 * | 1/2004 | Luberda | 165/173 |

FOREIGN PATENT DOCUMENTS

| | | |
|---|---|---|
| FR | 2 281 419 | * 3/1993 |
| FR | 2 793 015 | * 3/2000 |

* cited by examiner

*Primary Examiner*—Teresa J. Walberg
(74) *Attorney, Agent, or Firm*—Gary M. Hartman; Domenica N. S. Hartman; Hartman & Hartman

(57) ABSTRACT

A heat exchanger having a pair of manifolds and flat tubes for heat exchange between a first fluidum flowing inside the tubes and a second fluidum flowing outside of the tubes. The manifolds receive ends of the tubes and have an inlet and an outlet for introducing the first fluidum into the flat tubes and for discharging therefrom. Each manifold has at least two adjacent parallel channels with a partition wall therebetween. Each channel is further defined by at least a second wall, with at least part of the second wall having a curved surface. The partition wall defines two parallel substantially flat surfaces facing the channels. Each channel has a perimeter in cross-section defined by a continuous line having curved and straight portions.

17 Claims, 3 Drawing Sheets

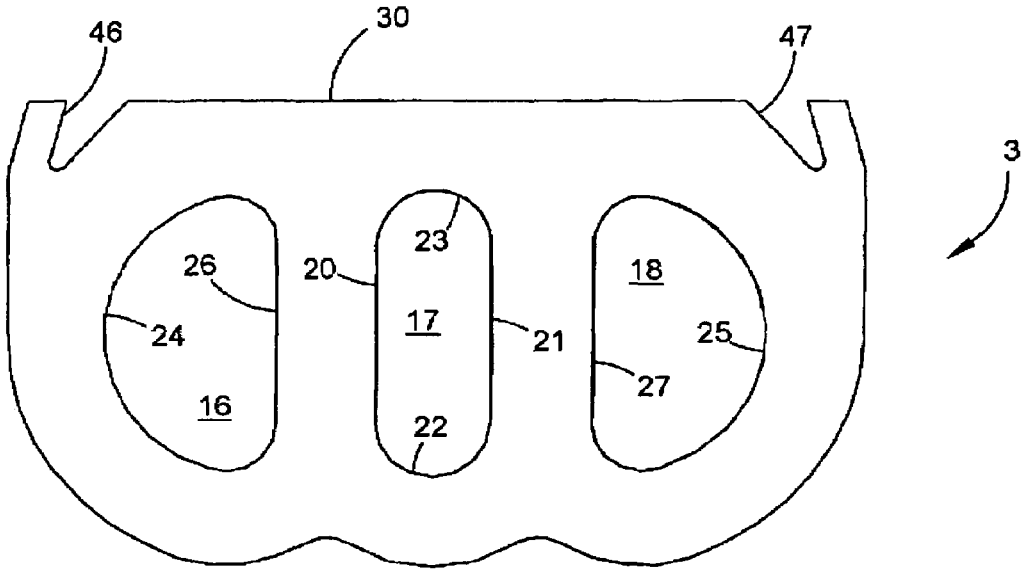
FIG. 2
FIG. 5
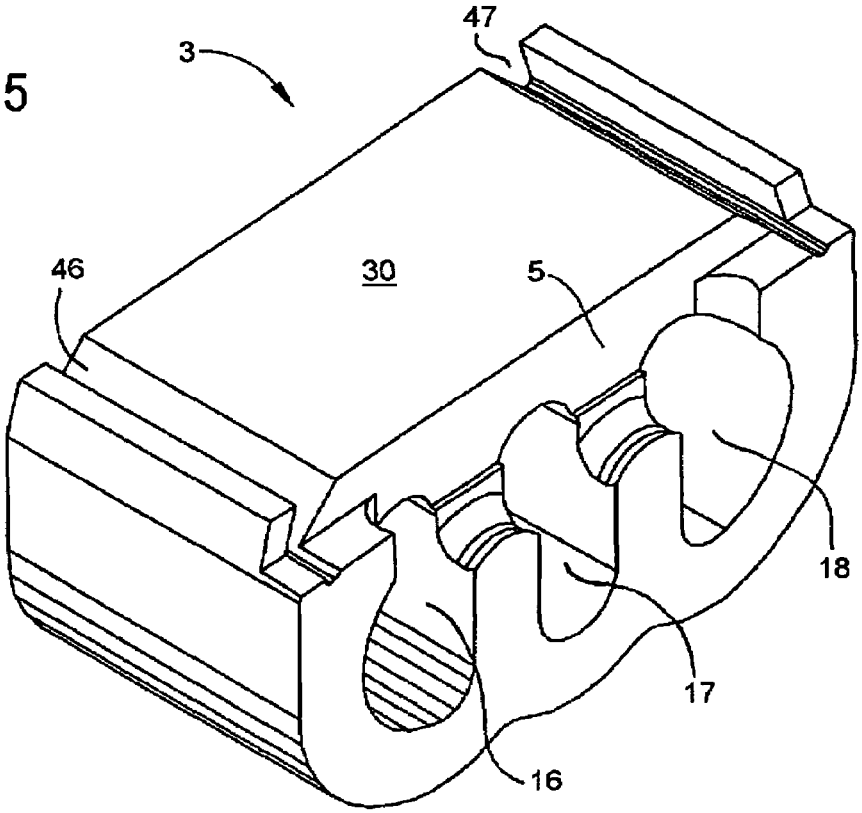

HIGH PRESSURE MANIFOLD

CROSS REFERENCE TO RELATED APPLICATIONS

This application claims the benefit of International Application No. PCT/EP01/09142 filed Aug. 6, 2001.

BACKGROUND OF THE INVENTION (1) Field of the Invention

The invention relates to a heat exchanger comprising a plurality of flat tubes for heat exchange between a first fluidum flowing inside said tubes and a second fluidum flowing outside of said tubes, a pair of manifolds connected to the end of the flat tubes and provider with an inlet and an outlet for introducing the first fluidum into the flat tubes and for discharging therefrom, each manifold being provided with at least two parallel channels, at least part of the walls of the channel having a curved surface.

(2) Description of the Related Art

Such a heat exchanger is known from WO-A-9851983.

In this known heat exchanger the manifolds are composed of a number of parallel tubes with circular cross-sections, each pair of adjacent tubes having a common wall portion, in such a way that the tubes of each manifold constitute a flat array of tubes. The circular cross-section of the tubes is selected because the high pressure inside the tubes, such as is common in modern heat exchangers used in cars and based upon CO2. It is common then to use a pressure well above 100 bar and the use of round cross-section channels avoid that stresses are built up in the walls of the manifold. Using round cross-section allows the inner wall to be thinner thereby saving weight and increasing heat transfer.

Otherwise a flat tube has to be inserted through holes, in one flat side of the manifold in order to have communication between the tubes and the manifolds. In order to have the least possible flow restriction it is preferred to insert the end portion of the flat tubes up to half way into the diameter of the channels in the manifold, as in this way the part of the end face of the flat tubes blocked by the partition walls in the manifold is minimal. However, in this way half of each channels in the manifold is blocked causing flow restriction in that part of the heat exchanger. As a compromise the end part of the flat tubes is not inserted up to half the diameter of the channels, but to about one third of the diameter. In this way the blockage in the channels of the manifold is substantially reduced, whereas the blockage of the end face of the flat tubes is only slightly increased and kept within acceptable limits.

However the disturbance of the fluid flow inside the heat exchanger, and especially inside the manifold channel is still highly disturbed by the inserted end portion of the flat tubes, which especially in high pressure systems can cause substantial pressure drops.

BRIEF SUMMARY OF THE INVENTION

It is therefor an object of the invention to provide a heat exchanger in which this problem is substantially reduced.

This object is achieved in that the partition wall between any of two adjacent channels is provided with two parallel substantially flat surfaces facing the channels.

In this way it becomes possible to make channels having elongated cross-sections, each of which is only blocked to a minor extent by the inserted flat tubes. The use of flat surfaces in the partition walls is possible without causing exaggerated stresses in the walls, because both surfaces of the wall are subjected to the same, be it high pressure, thereby balancing the forces.

BRIEF DESCRIPTION OF THE DRAWINGS

FIG. 2 is a cross-section along line 2—2 of the manifold of FIG. 1.

FIG. 5 is a perspective view of a part of the manifold of FIG. 4.

DETAILED DESCRIPTION OF THE INVENTION

Figure 1:
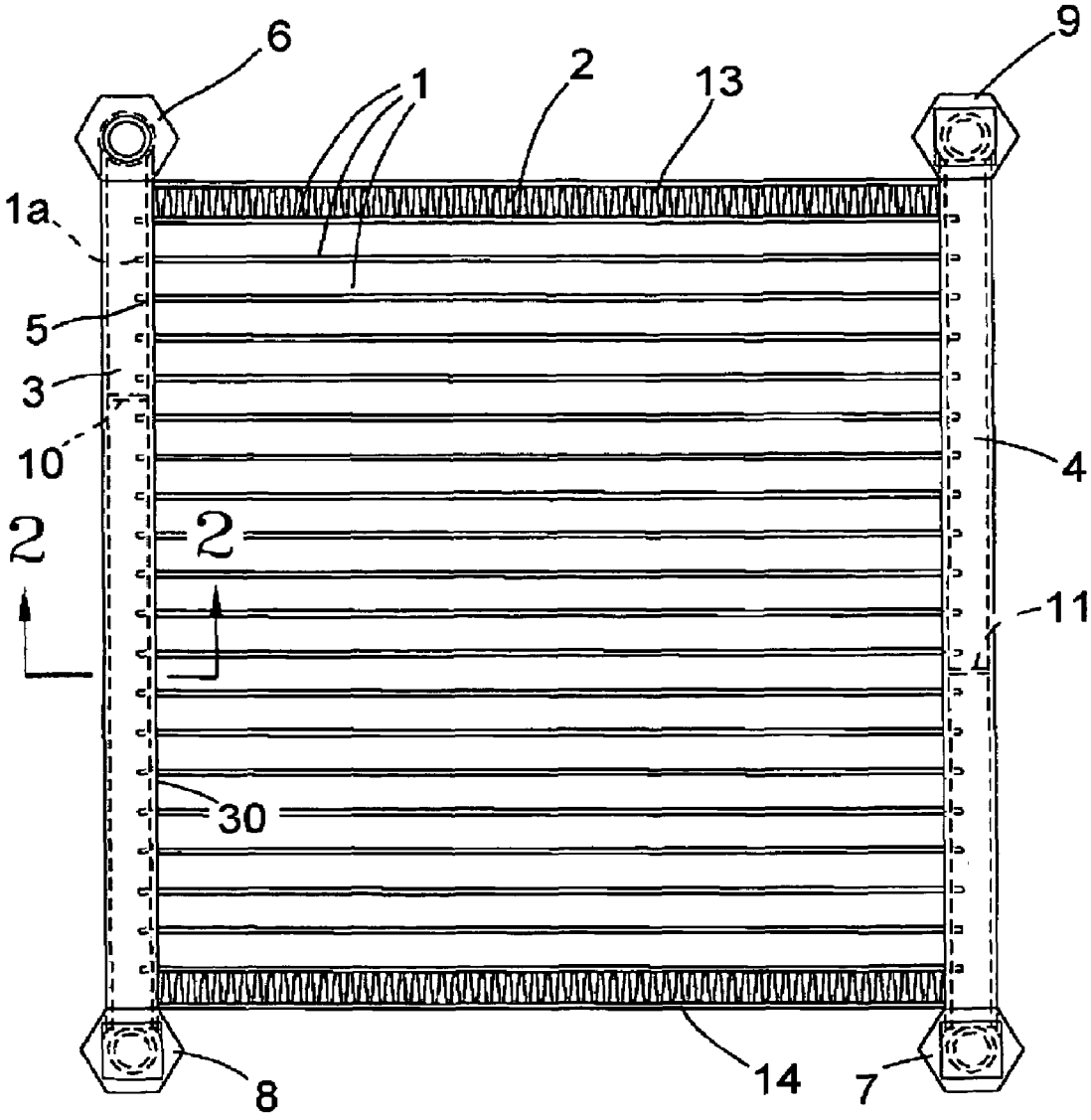
FIG. 1 is schematic view of a heat exchanger according to the invention.

Referring to FIG. 1, the illustrated heat exchanger includes a plurality of flat heat transfer tubes 1 stacked in parallel and corrugated fins 2 sandwiched between the flat tubes 1. The ends 1*a* of the tubes 1 are connected to manifolds 3 and 4. Each heat transfer tube may be made of extruded aluminium, having a flat configuration. Alternatively, the flat tubes can be multi-bored flat tubes, commonly called multiport tubes or else, electrically seamed tubes can be used. Multiport tubes may be made by extrusion, but otherwise it is possible to make such tubes by rolling from clad sheet, folding and brazing. Furthermore, it is possible to use a welded tube with an inserted baffle.

In the embodiment shown each corrugated fin 2 has a width approximately similar to that of the flat tube 1 but other widths may be used as well. The fins 2 and the flat tubes 1 are brazed to each other. The manifolds 3,4 are made up of aluminium tubes with holes 5 of the same shape as the cross-section of the heat transfer tubes 1 so as to accept the tube ends 1*a*. The holes 5 can also be tailor made, e.g. conical, so as to allow easier access for the flat tubes.

The inserted tube ends 1*a* are brazed in the holes 5. As shown in FIG. 1, manifolds 3 and 4 are connected to an inlet manifold 6 and an outlet manifold 7, respectively. The inlet manifold 6 allows a heat exchanging fluid to enter the manifold 3, and the outlet manifold 7 allows the heat exchanging fluid to discharge. The manifolds 3 and 4 are closed with caps or plugs 8 and 9, respectively. The reference numerals 13 and 14 denote side plates attached to the outermost corrugated fins 2.

The manifold 3 has its inner space divided by a baffle 10 into two sections, and the manifold 4 is divided into two sections by a baffle 11. In this way a medium path is provided starting from manifold 3, passing through a first set of tubes 1, through part of the manifold 4, passing through a second set of tubes 1 to manifold 3 and passing through a third set of tubes 1 to manifold 4 and to leave the heat exchanger unit through outlet 7. It is clear that these manifolds without baffles are also possible and otherwise manifolds with more than one baffle per manifold can be applied as well.

Figure 3:
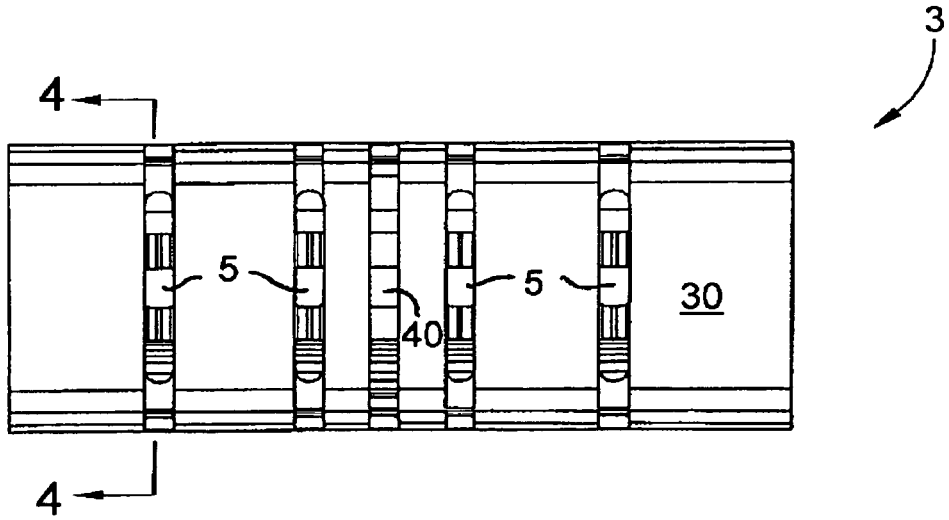
FIG. 3 is a plan view of a portion of a flat wall of the manifold of FIGS. 1 and 2.
Figure 4:
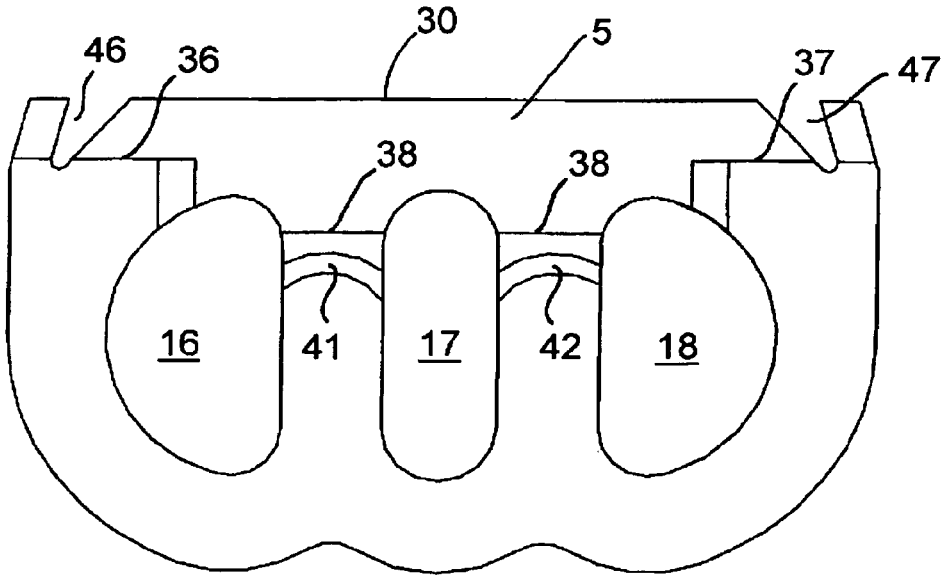
FIG. 4 is a cross-sectional view of the manifold along line 4—4 of FIG. 3.

The Heat Exchanging Fluid Flows in Zigzag Patterns Throughout the Heat Exchanger Unit The manifolds 3 and 4 are basically identical and in the FIGS. 2–4 an example of the manifold 3 is shown in more detail. The manifold 3 consists in fact of a multiple port extruded tube and in the example shown three channels 16, 17 and 18 are present. It is however clear that any number of channels may be present. As clearly shown in FIG. 2 the central channel 17 has an oval cross-section, i.e. it has two parallel side walls 20, 21 and two semi-circular end walls 22, 23. In case the manifold has more than three channels each intermediate channel will have that type of shape. Otherwise the two outer channels 16 and 18 have identical cross-sections and are composed of a substantially semi-circular side-wall 24 and 25 respectively and a flat side wall 26 and 27 respectively facing the respective flat side walls of the channel 17.

The outer surface of the manifold is formed by walls which are substantially parallel to the inner walls of the channels 16, 17 and 18 facing the outer wall, except for one side wall 30 which is perpendicular to the side walls 26, 20, 21 and 27 and which is made flat. By shaping the manifold in this way it is possible to withstand high internal pressures without generating excessive stresses in the walls of the manifold 3. In fact the pressure in channel 17 on the flat side wall 20 and 21 is compensated by the pressure acting on the flat side walls 26 and 27. Furthermore the remaining side walls are all curved thereby avoiding the building up of excessive stresses and making the manifold suitable for high pressure applications.

Moreover the cross-section of the manifold 3 can be easily adapted for different applications without having to increase the width of the manifold, by simply adjusting the length of the flat sidewalls 26, 20,21 and 27, whereby the volume of the channels is adjusted accordingly.

As shown in FIGS. 3 and 4, the flat outer wall 30 is provided with a number of the holes 5 discussed above in reference to FIG. 1. The holes 5 are shown as longitudinal and extending perpendicular to the longitudinal direction of the manifold 3. Each hole 5 is made in the following way, as clearly shown in FIG. 3. Up till the line 36–37 there is made a groove with rectangular cross-section and a width equal to the width of the flat tube to be inserted in the hole 5, i.e. the smallest dimension of the flat tube 1. This groove can be made by sawing, or the like. Subsequently the hole 5 is further shaped by punching, using a die with the right shape, whereby the groove is connected to the channels 16, 17 and 18. The punch die is shaped in such a way that both longitudinal sides of the hole 5 are provided with an edge 38 serving as a stop for the insertion of the flat tube 1 in the hole 5. Furthermore the wall portion 26–20 and 21–27 between the channels 16, 17 and 18 respectively are pushed back to some extent below the edge 38, as seen in FIG. 3, thereby forming two substantially semi-circular top walls 41 and 42, so that after insertion of a flat tube up till the edge 38, an open connection is present between the channels 16, 17 and 18, enabling a cross-flow of the medium in the manifold 3. In this way a manifold is obtained which makes an easy mounting of the flat tubes possible. Because of the shape of the channels 16, 17 and 18, the end portions of the flat tubes 1 will only slightly penetrate in the flow section of the channels 16, 17 and 18, and thereby only influence to a minor degree the flow of medium through the channels 16, 17 and 18. Because of the lower position of the separation walls 41 and 42 between the channels 16, 17 and 18 at the place of the flat tubes, the flow of medium from the manifold 3 to the tubes 1 or reverse will not be hindered by the separation walls 41 and 42, as there is sufficient space between the walls 41 and 42 and face of the inserted flat tube 1 which will reach up till the line 38.

As shown in FIG.4 an additional opening 40 is present between two adjacent holes 5, which opening 40 can be used for the insertion of a baffle 10 or 11 as explained above. The only difference with the holes 5 for the flat tubes 1 is that there is no edge 38 and the wall portions 41 and 42 shown in FIG. 3 are removed up till halfway the height of the channels 16 and 17.

The flat wall 30 of the manifold 3 is provided with two longitudinal grooves 46 and 47. These grooves 46 and 47 can be used to clamp a brazing sheet on top of the manifold 3. After placing a brazing sheet on the surface 30, and folding the edges of that sheet into the grooves 46 and 47, the grooves 46 and 47 can be deformed in such a way that the longitudinal edges of the brazing sheet are clamped to the manifold 3. After insertion of the flat tubes 1 into the manifold 3 and insertion of the baffle 10, the whole manifold 3 can be heated, e.g. by means of a brazing oven, and during this process the brazing sheet ensures that a reliable connection is obtained between the flat tubes 1 and the manifold 3.

It is clear that the invention is not restricted to the embodiment described above, but that modifications can be applied without departing from the scope of the invention. More especially it is possible to use other systems for connecting the tubes to the manifold.

Therefore, while the invention has been described in terms of a preferred embodiment, it is apparent that other forms could be adopted by one skilled in the art. Accordingly, the scope of the invention is to be limited only by the following claims.

The invention claimed is:

1. A heat exchanger comprising a pair of manifolds and a plurality of flat tubes for heat exchange between a first fluidum flowing inside the flat tubes and a second fluidum flowing outside of the flat tubes, the manifolds receiving ends of the flat tubes and having an inlet and an outlet for introducing the first fluidum into the flat tubes and for discharging therefrom, each manifold comprising a first wall defining a flat outer surface, a second wall defining a curvilinear outer surface, holes in the first wall in which the ends of the flat tubes are received, and at least two adjacent parallel channels with a partition wall therebetween that is oriented substantially perpendicular to the flat outer surface and interconnects the first and second walls, each of the channels being further defined by a curved inner surface portion of the second wall, the partition wall defining two parallel substantially flat surfaces facing the channels, each channel having a perimeter in cross-section defined by a continuous line consisting of curved and straight portions wherein all straight portions of the channels are defined by the partition wall and are perpendicular to the flat outer surface of the first wall.

2. A heat exchanger according to claim 1, wherein each channel is wider in a direction parallel to the flat surface defined by the partition wall than in a direction perpendicular thereto.

3. A heat exchanger according to claim 1, wherein each channel has a maximum width in a direction parallel to the flat outer surface that is less than a maximum length of the partition wall in a direction perpendicular to the flat outer surface.

4. A heat exchanger according to claim 1, wherein portions of the partition wall are partially removed to define end faces on the partition wall and define extensions of the holes.

5. A heat exchanger according to claim 4, wherein the holes and the flat tubes have corresponding circumferences, the partition wall defines a shoulder within each hole, and the shoulders are parallel to the flat outer surface of the manifold and are stops for the ends of the flat tubes received in the holes.

6. A heat exchanger according to claim 4, wherein the end faces of the partition wall are curved.

7. A heat exchanger according to claim 1, wherein the flat outer surface of at least one of the manifolds comprises a second hole, the manifold further comprising a baffle within the second hole for separating fluid flow within the manifold.

8. A heat exchanger comprising a pair of manifolds and a plurality of flat tubes for heat exchange between a first fluidum flowing inside the flat tubes and a second fluidum flowing outside of the flat tubes, each of the manifolds comprising:

a first outer wall having a flat outer surface;

a second outer wall having a curvilinear outer surface;

at least one partition wall interconnecting the first and second outer walls and oriented substantially perpendicular to the flat outer surface of the first outer wall;

at least two adjacent parallel channels separated by the partition wall, each channel having an interior surface consisting essentially of a substantially flat surface defined by the partition wall and a curvilinear surface defined by a portion of the second outer wall, the flat surfaces of the channels being substantially parallel to each other and substantially perpendicular to the flat outer surface of the first outer wall, each channel having a perimeter in cross-section defined by a continuous line consisting of curved and straight portions wherein all straight portions of the channels are defined by the partition wall and are perpendicular to the flat outer surface of the first outer wall; and holes defined in the first outer wall, the holes receiving ends of the flat tubes.

9. A heat exchanger according to claim 8, wherein the flat surface and the curvilinear surface of each channel are contiguous.

10. A heat exchanger according to claim 8, wherein each of the manifolds comprises at least two of the partition walls so as to define at least three of the channels, each of the channels having a perimeter in cross-section defined by a continuous line consisting of curved and straight portions wherein all straight portions of the channels are defined by the partition walls and are perpendicular to the flat outer surface of the first outer wall.

11. A heat exchanger according to claim 10, wherein a first of the channels is between the partition walls so that the first channel has two opposing flat surfaces defined by the partition walls, the curvilinear surface of the first channel interconnecting the two opposing flat surfaces thereof so that the first channel has a substantially oval cross-sectional shape.

12. A heat exchanger according to claim 11, wherein the first channel is between a second and a third of the channels, each of the second and third channels having a cross-sectional shape comprising a semi-circular surface defined by the second outer wall and oppositely-disposed from one of the flat surfaces of one of the partition walls.

13. A heat exchanger according to claim 12, wherein the first, second and third channels are each wider in a direction parallel to the flat surfaces defined by the partition walls than in a direction perpendicular thereto.

14. A heat exchanger according to claim 12, wherein portions of each of the partition walls are partially removed to define end faces on the partition walls and define extensions of the holes.

15. A heat exchanger according to claim 14, wherein the holes and the flat tubes have corresponding circumferences, each of the partition walls defines a shoulder within each hole, the shoulders are parallel to the flat outer surface of the manifold, and the ends of the flat tubes abut the shoulders.

16. A heat exchanger according to claim 14, wherein the end faces of the partition walls are curved.

17. A heat exchanger according to claim 8, wherein each channel has a maximum width in a direction parallel to the flat outer surface that is less than a maximum length of the partition wall in a direction perpendicular to the flat outer surface.

* * * * *